US005634442A

United States Patent [19]

Weber

[11] Patent Number: 5,634,442

[45] Date of Patent: Jun. 3, 1997

[54] METHOD AND APPARATUS PROVIDING COLD STARTUP ASSISTANCE FOR SMALL GASOLINE FUELED ENGINES

[75] Inventor: Harold J. Weber, Holliston, Mass.

[73] Assignee: Astute Frontiers Patent Trust, Holliston, Mass.

[21] Appl. No.: 402,878

[22] Filed: Mar. 13, 1995

[51] Int. Cl.[6] ..... F02M 1/16

[52] U.S. Cl. ..... 123/179.8; 123/179.11

[58] Field of Search ..... 123/179.8, 179.9, 123/179.11; 261/DIG. 8

[56] References Cited

U.S. PATENT DOCUMENTS

| | | | |
|---|---|---|---|
| 1,582,137 | 4/1926 | Harrington | 123/179.8 |
| 2,857,900 | 10/1958 | Neely | 123/179.8 |
| 2,860,009 | 11/1958 | Orr | 123/179.11 |
| 3,205,882 | 9/1965 | Fiedler et al. | 123/179.9 |
| 3,379,185 | 4/1968 | Frisch | 123/179.8 |

*Primary Examiner*—Andrew M. Dolinar

[57] ABSTRACT

Start-up assistance is provided for small low-horsepower gasoline fueled internal combustion utility engines. A portable supply of starting fuel, such as naphtha, benzine, benzol, ether or alcohol, is directly injected through an temporarily openable aperture effective as an indraft port and entered into the carburetor bore, or an intercurrent carburetion duct utilized between the carburetor and the engine's intake port, to thereby enable immediate intake of the starting fuel through the engine valving and permit spark ignition and combustion upon initial engine cranking. Manual starting fuel injection also serves to overcome engine start-up difficulty generally caused by the inferior low-temperature volatility of contemporary gasoline products. As a result, this occurrence of nearly immediate engine firing remarkably enhances the liklihood for carburetion and induction of the usual running fuel supply and continued engine operation.

20 Claims, 5 Drawing Sheets

Figure 1:
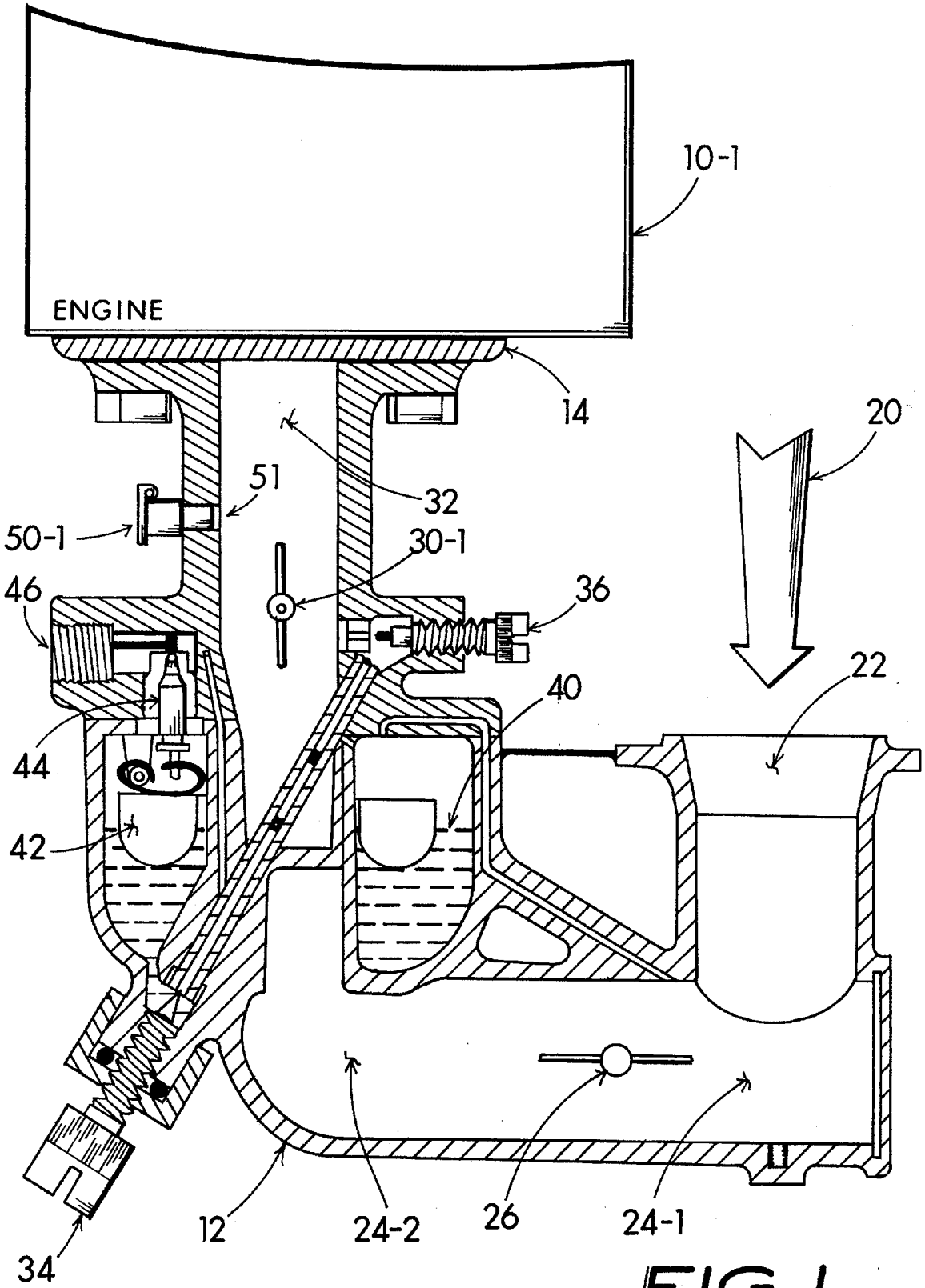

METHOD AND APPARATUS PROVIDING COLD STARTUP ASSISTANCE FOR SMALL GASOLINE FUELED ENGINES

FIELD OF MY INVENTION

My invention relates to the field of spark ignited internal combustion engines in general and in particular to carburetted gasoline fueled utility engines usually having one or two cylinders and commonly used to power lawn mowers, small tractors, tillers, grass trimmers, standby generators, snow blowers, snow mobiles, chain saws and other kinds of small-engine powered machines and tools. My invention also relates to supplementing the volatility of the engine's fuel supply at the moment of start-up and thereby alleviate a reduced vaporability of contemporary gasoline fuel necessitated by increasingly strict government regulations, whereby the conforming gasoline has subdued volatility which aggravates startability of an engine.

BACKGROUND OF MY INVENTION

Single cylinder (and twin cylinder) petroleum fueled internal combustion utility engines are used in a variety of applications by homeowners, tradesmen and others. Utility engines are ordinarily produced in two fundamental familial types, e.g., "two cycle" and "four cycle" (viz, "two stroke" and "four stroke"). Each of these engine types operate with four cardinal events, including: 1) INTAKE, 2) COMPRESSION, 3) COMBUSTION and 4) EXHAUST. However the two cycle engine achieves these four events in one revolution or two strokes of the crankshaft (i.e., one piston downstroke and one piston upstroke) while the four cycle engine requires two crankshaft revolutions and four strokes (i.e., two piston downstrokes and two piston upstrokes).

While the two stroke engine is decidedly simpler design (and manufacture) it requires mixing and storage of a special fuel and oil mixture. In fact it is arguable that a two cycle engine may have merely three moving parts: the crankshaft, connecting rod and piston with perchance room for quibble over whether the reed type intake valve ordinarily used with Small engines is a moving part or not. Other drawbacks for two cycle engines include a lack of good lugging ability, low efficiency, pollution considerations and compromised reliability under extended operation. Two cycle engines are also ordinarily designed to operate with relatively high crankshaft speed r.p.m. to achieve reasonable efficiencies and output power, but with relatively poor speed regulation and relatively high noise level. Furthermore, high crankshaft r.p.m. also translates into increased mechanical wear. Two cycle engines are most economical in small horsepower ratings and rarely are they built in multicylinder versions. In spite of these drawbacks two cycle engines find widespread application in chain saws, string type weed cutters, small lawnmowers, outboard boat motors, snow mobiles and the like.

Four cycle engines, on the other hand, tend to be preferable when long term reliability, durability and stable performance is a criteria. Operation from ordinary gasoline, alcohol or "gasahol" affords simple fuel needs (i.e., no fuel-oil mixtures). Four cycle engines may be produced to operate well at low crankshaft speeds (under 2,000 r.p.m.) and with excellent speed constancy in applications such as engine driven alternator sets where speed control is all-important in order to stabilize the frequency of the delivered power. A vast majority of small four cycle engines finding use in everyday application in the home and on the job more suitably operate in the 3,000–4,000 r.p.m. range, which has been demonstrated as an optimal trade-off between speed, engine bulk, mechanical life, or in a more practical sense, in engine cost. Small general purpose four cycle engines are produced in single and multiple cylinder models and with popular horsepower ratings more or less between about 3 and 15 horsepower find wide application on lawnmowers, small tractors, generator sets, pumps and a myriad array of other such workaday applications where stable and long term performance are vital.

Small engines of this type, either 2-cycle or 4-cycle in principle construction, categorically suffer from frequent application in machines where they encounter long periods of non-operation. For example, Winter storage of a lawn mower or tiller leads to non-usage for many months. Likewise, seldom used "standby" electric power generators find long periods of shut-down, sometimes even years of sitting without a startup. Machines such as a homeowner's chain saw and tiller find infrequent usage and seasonal machines such as snow blowers, snow mobiles and the like may go for 6–9 months or more without startup. In each of these cases, where an engine is stored for long intervals without use, immediate startup on demand is unlikely and becomes progressively more difficult as the engine's age increases.

In recent times, the federal government's Environmental Protection Agency (EPA) and Department of Energy (DOE), as well as state environmental agencies, have contrived a collection of rules and regulations pertaining to fuel quality, exhaust emissions and other factors which are the anathema of carbureted internal combustion engines. Contemporary "blended" gasoline meeting general fuel requirements for reduced volatility is particularly troublesome to small engine design. Due to cost restraints, simplicity has been the goal of carburetor design for years. Furthermore, easy and relatively "foolproof" operation by users has dictated that a carburetor should have few (if any) adjustments which has led to total compromise between start-up and running mode design requirements for the carburetor. In other words, if the engine doesn't quickly start, there is not much which the ordinary user can do to enhance the possibility for startup. From the overall market viewpoint, such simplicity is desirable since the end-user of the engine is frequently totally inept as a mechanic and any available adjustments would, in most cases, merely reduce the liklihood for successful engine startup. More to the point, however, is that in order to meet the goal for emissions reduction, carburetor settings need to be fixed within narrow bounds and the only assurance a manufacturer has that such bounds will be maintained is to effectively "seal" or restrictively pre-set as many of the carburetor adjustments as possible. As a result, carburetion on a contemporary small engine becomes simply a "go or no-go" proposition with little, if any, possibility for "tweeking" the carburetor to better the chances for cold startup.

Combining these simplified prior-art carburetor designs with infrequent engine usage leads to difficulty in achieving quick engine startup which may be due in part to a total evaporation of any residual gasoline vapors which might otherwise stimulate engine startup. In addition, the reduced volatility of the mentioned blended-gasoline fuels which are now being produced (which exhibit an exceptionally low amount of volatile ingredients) leads to difficulty in getting gasoline "fumes" to draw through a typical small engine carburetor especially at the relatively low cranking speeds characteristic of such engines and particularly when using a common rope-start (e.g., "recoil-start") mechanism.

A direct implication of these various factors of carburetor simplicity, fuel blending and exhaust emission considerations is that quick and reliable start-up of small gasoline engines is becoming more and more problematic. As a result of the increasing need for achieving better start-up of these kinds of small engines, I have conceived an easy to use and inexpensive approach for introducing a supply of priming fuel directly into the engines intake port whereby engine start may be expected to Occur with the first pull of the starting rope.

OBJECT OF MY INVENTION

My invention's object is to overcome difficult startup for small single and twin cylinder gasoline fueled utility engines. In particular, I intend to show a reliable and reasonably convenient provision for priming and inducing quick and dependable start-up of these kinds of small engines which have been extraordinarily difficult to start, especially by the non-mechanically inclined user and when the engine is no longer "brand new" and in pristine condition.

It is furthermore my intent to show that such a quick-start provision may be beneficial to nearly all classes of small engines which depend upon gasoline fuel, especially when the engine encounters infrequent or seasonal usage.

It is also a goal for my invention to deliver enhanced startup without tampering with any fundamental portions of the engine or carburetor which might lead to misadjustment and increased emissions or reduced efficiency. My invention obtains the sought improvements without tampering with or compromising any design provisions included on a carburetor or engine which a manufacturer has engineered to comply with Federal or State environmental regulations. Additionally, my invention teaches a safe and easy to use prestart fuel priming method which is inherently an inexpensive inclusion for an engine manufacturer. As a result, the invention is extremely cost-effective in view of the improved probability for immediate start-up of an ordinary gasoline fueled utility engine combined with customer satisfaction achieved when the engine appears easy to start.

SUMMARY OF MY INVENTION

My invention is an adaptation or modification of the fundamental structure of a carbureted intake duct portion of an internal combustion engine to include a temporarily uncoverable aperture or indraft port through which a measure of starting fuel may be directly injected, whereafter the aperture is closed and the engine is then cranked to produce start-up. Ordinarily, the aperture is entered through the wall of the intercurrent carburetion duct situate between the carburetor throttle plate and the engine's intake valve port. As a result of this direct injection of fuel substantially into the intake valve port, the cranking of the engine produces an immediate induction of starting fuel admixture into the engine's compression chamber which usually brings about quick and sure engine firing. Once the engine fires, the main running fuel supply for the carburetor is brought into play and, if all else is well with the engine's fuel and ignition system, the engine will continue to run.

Starting fuel is provided in a portable containment vessel for direct injection through the openable aperture in the intake manifold or intake duct. The starting fuel is ordinarily formulated to have a good level of volatility and may typically include mixtures of benzine and alcohol, naphtha, or other suitable fuels having above average volatility. A small portion of alcohol included in the starting fuel is believed to improve start-up of a long-stored engine since the alcohol's affinity for water may absorb moisture which has inadvertently entered the combustion chamber. The containment vessel may be an "aerosol bomb" dispenser, a squeezable bottle, or a finger-actuated pump dispenser bottle. The "aerosol bomb" dispenser, if fitted with a pipette extension permitting direct injection through the temporarily uncoverable indraft port is particularly attractive as a sealed containment vessel since it permits storage and dispensing of unusually volatile starting fuel admixtures, such as ether and blends of benzine and ether, benzine blended with propane or butane and other suitable starting fuel compounds. Starting fuels have been available for a long time in aerosol containers and therefore it shall be realized that the essence of my invention is not the use of starting fuels to prompt engine startup, but rather it is the inclusion of a here-to-fore unprovided temporarily openable aperture entered as a temporal indraft port directly into the engine's intake port region through which a manual injection of a portion of any starting fuel provided in a portable containment vessel may be utilized to enhance start-up of a cold, damp or long-stored internal combustion engine.

It is therefore a purpose of my invention to teach inclusion of a temporarily uncoverable indraft port aperture entered through the wall of a carburetor's bore or intercurrent carburetion duct to enable manual injection of starting fuel proximate with the engine's intake port.

An aspect of my invention is to utilize a portable containment vessel which provides a supply of manually dispensable starting fuel admixture which may be injected through the temporarily uncoverable indraft port.

A further purpose of my invention is to provide quick startup of gasoline engines having substantially fixed or factory preset carburetor adjustments and little if any provision for field re-adjustment.

My overall intent for the invention involves achieving the injection of a hypervolatile starting fuel directly into a small engine's input port to assure quick start-up regardless of the length of time since the engine was previously run.

Another achievement of my invention is to lower the level of aggravation felt by a user when the engine stubbornly refuses to start and whereby the probability for immediate start-up is immensely enhanced by the direct injection of the prestart fuel through the indraft port provided in the carburetor bore or the intercurrent carburetion duct.

Finally, it is an objective of my invention to reduce the amount of effort expended by a user to start a gasoline fueled utility engine, thereby enabling even a physically limited person to achieve quick start-up of the engine.

It is these and other goals and advantages of my invention which are herewithin described by way of a specification, drawings and claims.

DESCRIPTION OF MY DRAWINGS

FIG. 1 View of a carburetor depicting various essential portions and including an indraft port for starting fuel injection.

Figure 2:
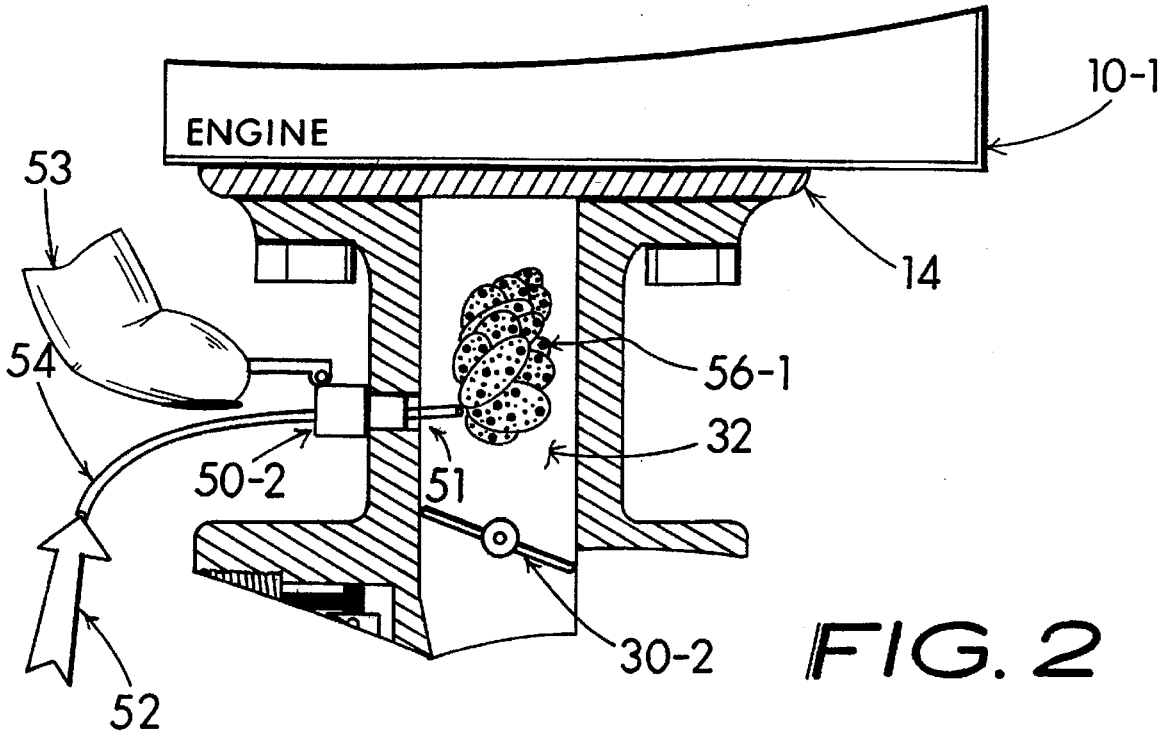

FIG. 2 Injection of starting fuel through indraft port and into carburetor bore.

Figure 3:
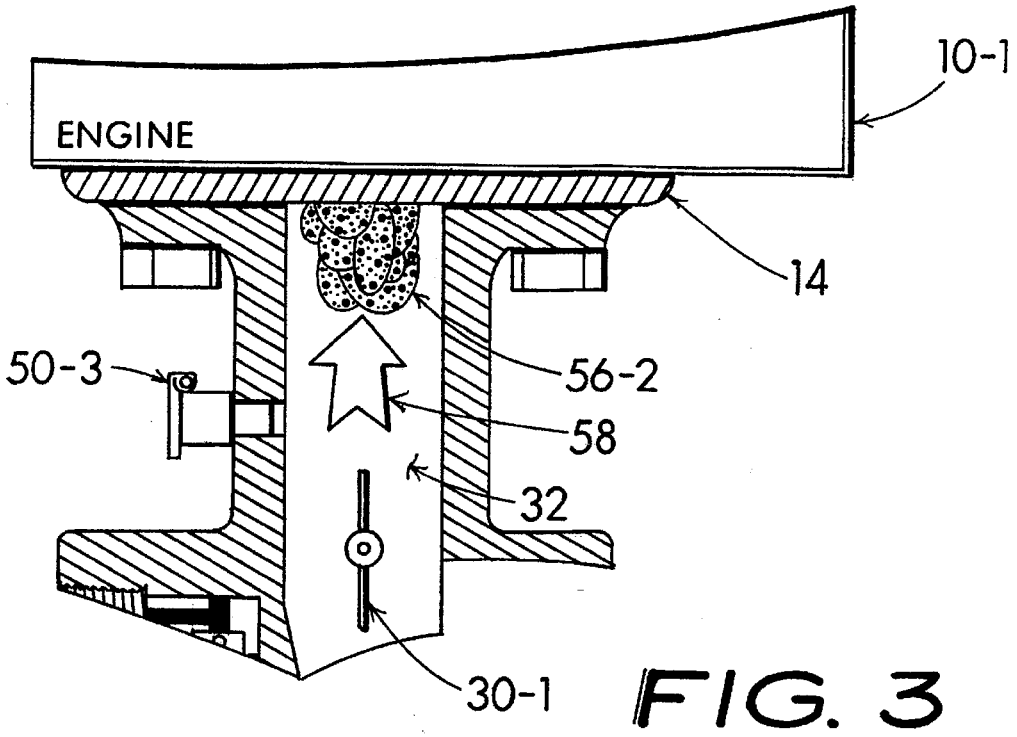

FIG. 3 Post-injection induction of starting fuel into engine intake port prior to start-up.

Figure 4:
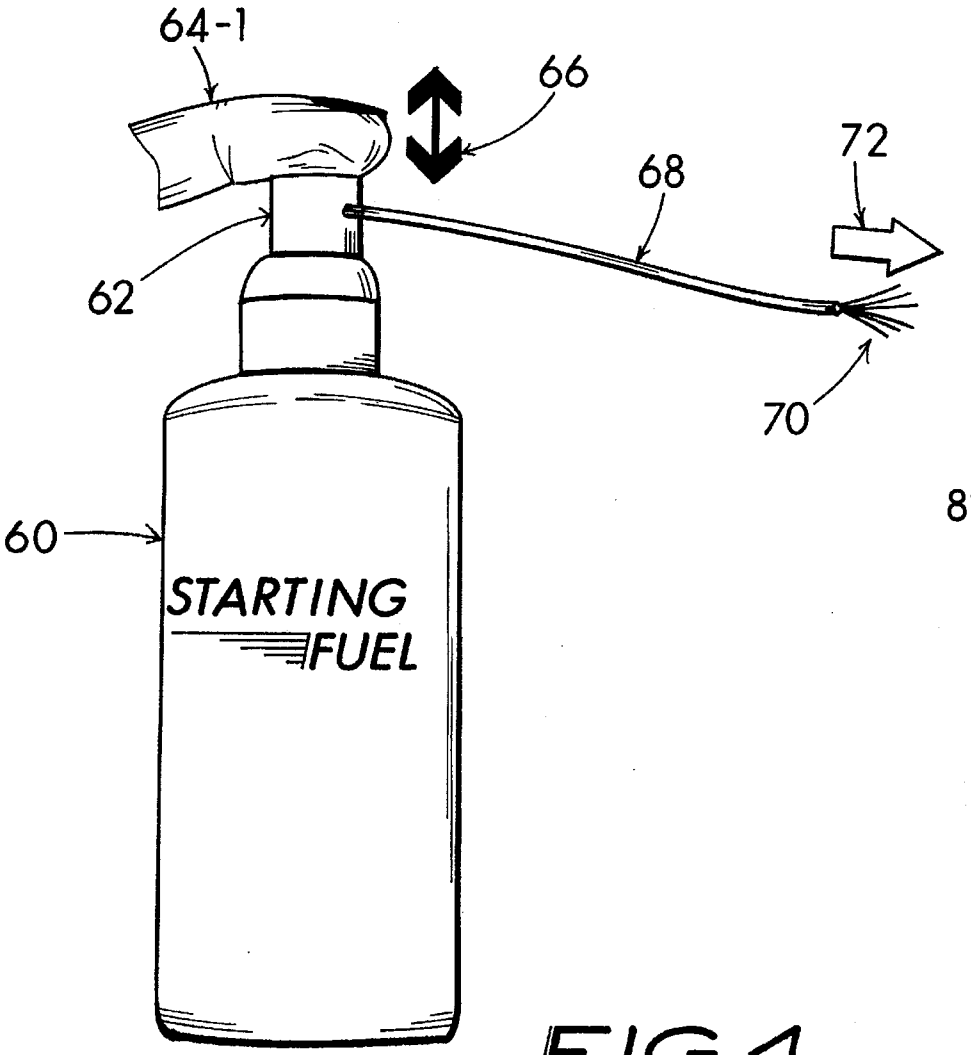

FIG. 4 Pump type of starting fuel dispenser.

Figure 5:
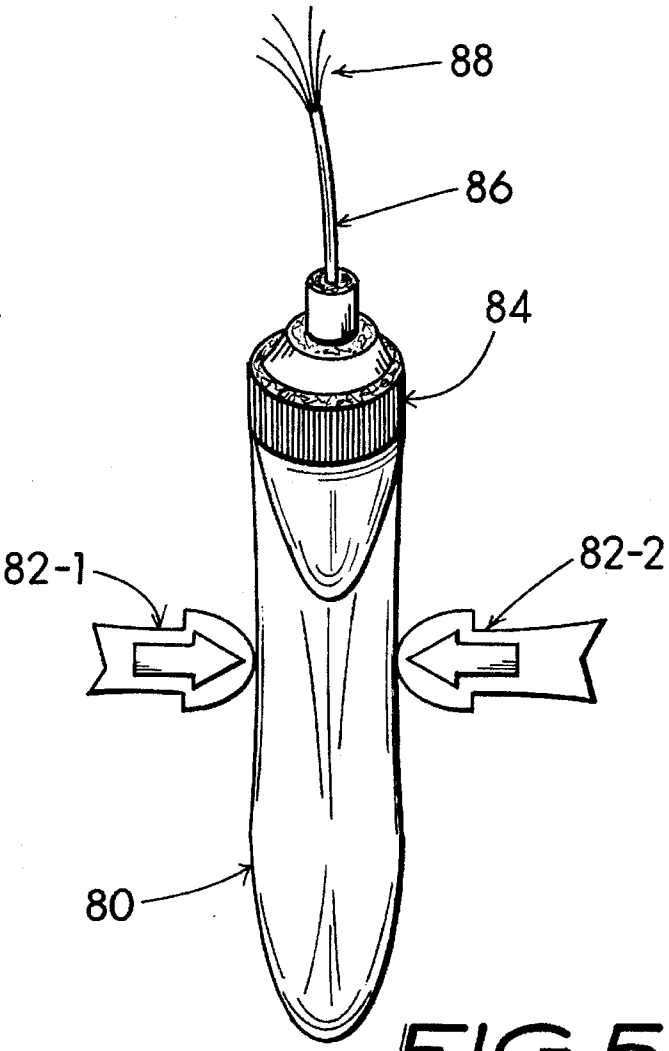

FIG. 5 Squeezable type of starting fuel dispenser.

Figure 6:
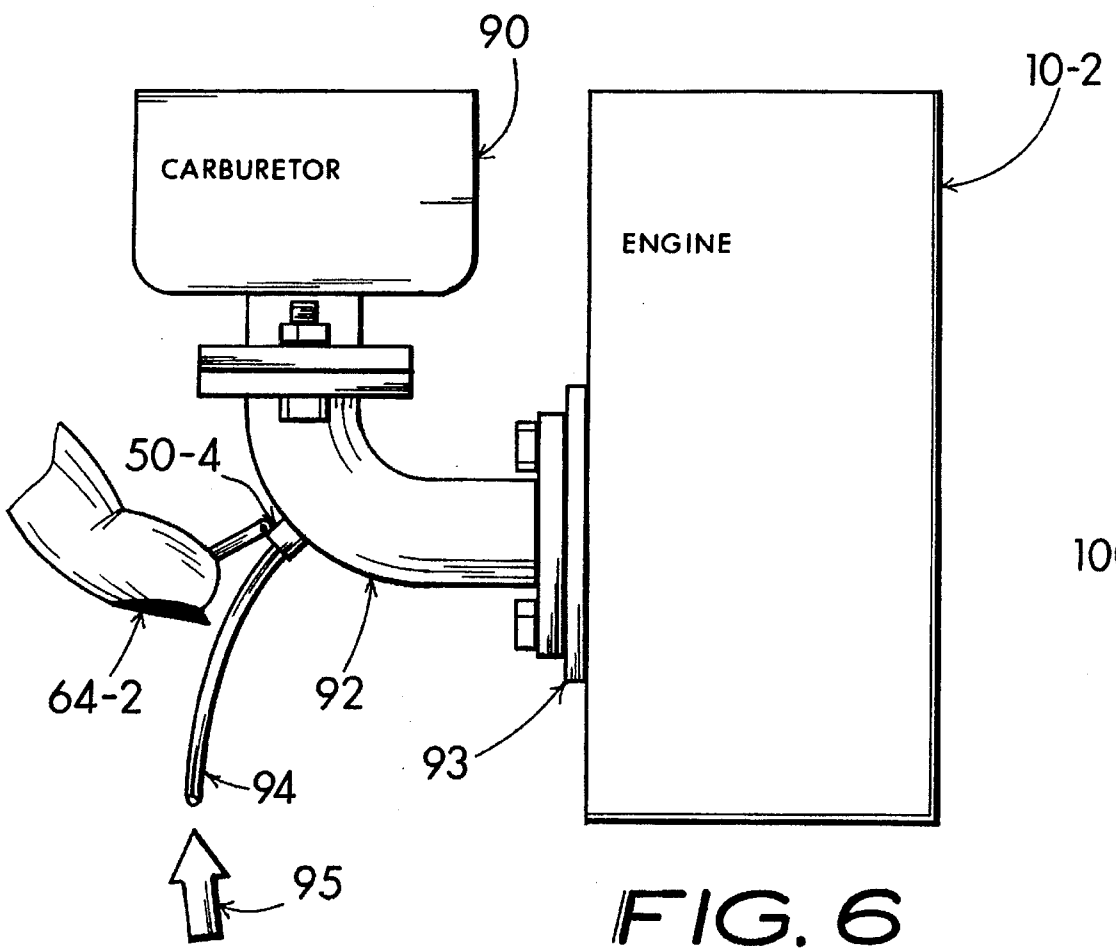

FIG. 6 Injection of starting fuel through an indraft port fitting fixed into an aperture in an intercurrent duct located between a carburetor and an engine.

Figure 7:
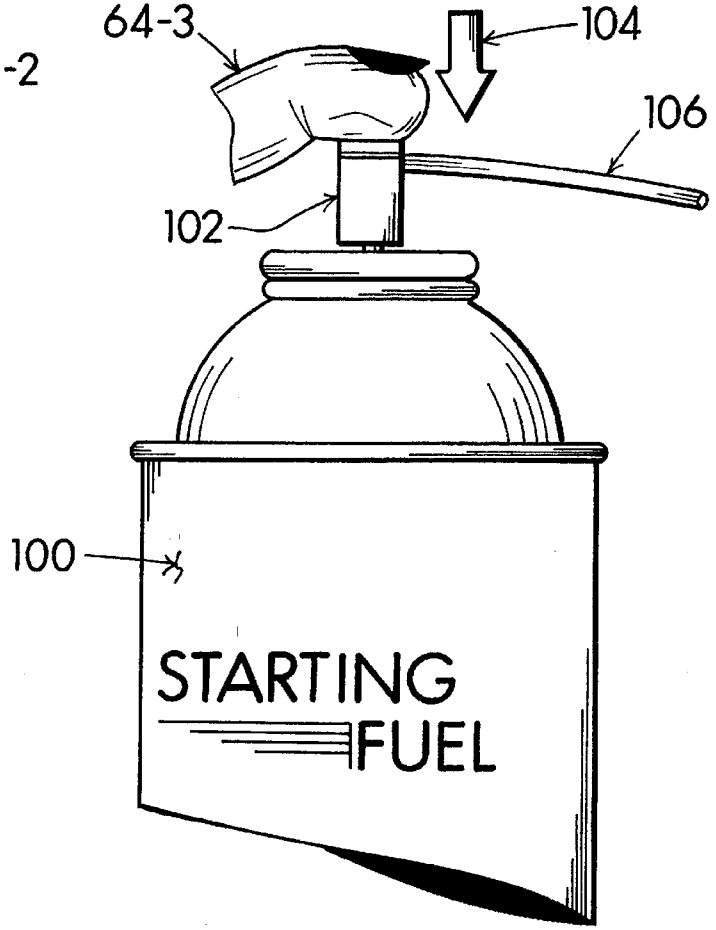

FIG. 7 Sealed and pressurized prefilled container, such as an "aerosol bomb" utilized for supply of starting fuel.

Figure 8:
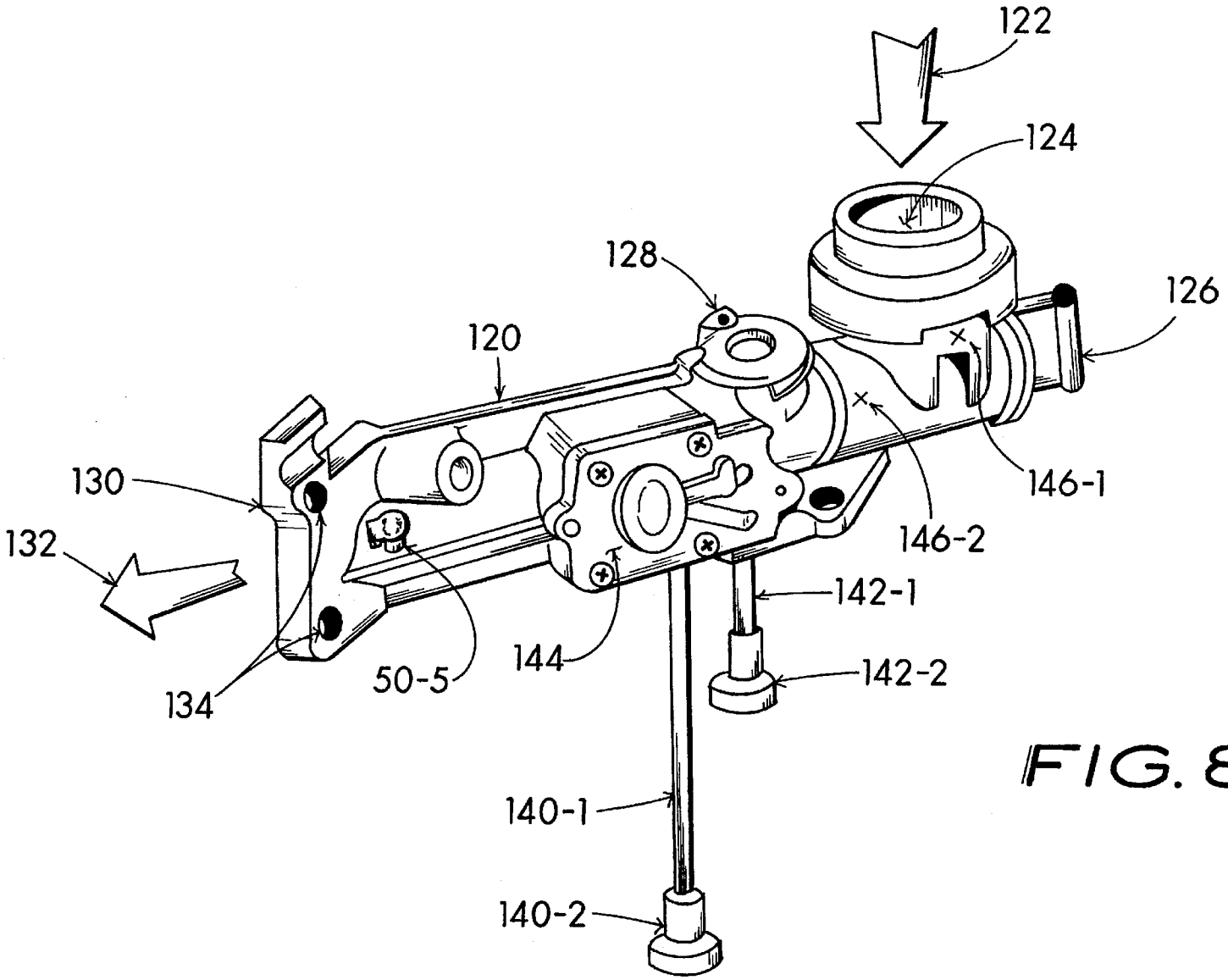

FIG. 8 Suction lift carburetor including an indraft port for pre-start fuel injection into the carburetor bore.

DESCRIPTION OF MY INVENTION

In FIG. 1 I depict a skeletal view of a carburetor 12 coupled with the intake port 14 of a small engine 10-1. In some applications, the outlet of the carburetor is coupled through an intermediate intercurrent carburetion duct which may include a right-angle bend to enable the vertically oriented carburetor bore to match a horizontal axis intake port on an engine. This carburetor design is particularly suited for small-engine usage in that it provides all of the essential portions of a carburetor having a fuel bowl in which the fuel level 40 is determined by a float 42 operating a needle valve, with running fuel supplied through an inlet 46. This carburetor is illustratively similar to a Briggs and Stratton Flo-Jet™ carburetor. Air, depicted by arrow 20, enters the carburetor inlet port 22 whereupon it is usually drawn along the carburetor bore 24-1, past a rotatable choke butterfly valve 26 to continue along the bore 24-2. When the engine is operating, the a high-speed needle valve 34 may be adjusted to permit fuel to be drawn into the carburetor bore. In a like way, an idle (or low-speed) needle valve 36 may adjust fuel flow into the carburetor bore to enriched the running fuel to air mixture proportion at idle. A rotatable throttle valve 30-1 regulates the "openness" of the carburetor bore and hence the amount of air and resulting air and fuel mixture which may pass into the intercurrent carburetion duct 32 portion of the carburetor and into the engine 10-1 intake port for combustion.

My invention's essence is to provide prestart fuel injection into virtually any small-engine carburetor and therefore this particular carburetor embodiment is shown merely for the purpose of overviewing carburetor action. An artisan will realize that this depiction serves to illustrate one particular type of carburetor to which my invention may find utility whereas, in practice, my invention is applicable to small engine carburetors of nearly any design configuration. While ordinary gasoline may suffice as a starting fuel for purpose of this invention, preferably the starting fuel is at least enhanced to have relatively high volatility (e.g., low vapor point) in order to increase probability for fuel vapors quickly reaching the engine's combustion chamber even in frigid weather or in a fully "dryed out" carburetor which has been stored for a long time. Ordinary gasoline, being a blend of fuel compounds, is inherently an admixture and when fresh may suffice as the starting fuel. A blend of alcohol or ether combined with the starting fuel may also overcome slight moisture accumulations in the combustion chamber which might wet the engine's spark plug to an extent sufficient to interfere with spark ignition.

An openable fitting 50-1, effective as the indraft port or starting fuel manual injection port, is fitted into an aperture 51 bored through the wall of the intercurrent carburetion duct and therefore the aperture's opening is immediately adjacent with the engine's intake port. Preferably, the indraft port 50-1 is on the engine intake side of the throttle valve and ported into the induction duct 32 (viz, intercurrent carburetion duct). I have found that in a practical sense, the nearer the engine's intake port 14 the better the improvement but any provision for injection of starting fuel along the carburetor bore is far superior to current art whereby no prestart provision is included for manual injection of a starting fuel.

A cold engine is best defined as one which is literally cold, one which has not been run for a long time, or one in which all of the usual running fuel has been exhausted (e.g., "run out of gas"). It may also be any engine in which start-up is desired after the engine has been out of service for a long time, such as a seasonal machine (e.g., lawnmower, snowblower, tiller, chain saw, etc.) which has not been used for many months.

In my invention's various depictions, I show the use of a hinged-cover "oiler" fitting used as the indraft port device 50-1. This type of fitting is well known, having been around for years as a coverable oiler, e.g. a receptacle for receiving oil from an oil can spout. It is found on bearing blocks, electric motors and other rotating machinery applications. In my unique application, the fitting is modified to include a neoprene or synthetic rubber seal under the lift-up lid in order to assure an airtight seal and no vacuum leak in the carburetor bore or the intercurrent carburetion duct. An artisan must realize that, in view of the maturity of the field of fittings as an artform, a particular type of fitting used as the indraft port access device is not central to and as a result imposes no limitation upon this invention's performance and that any manually openable (and tightly closeable) fitting which seals well when closed may be adapted to provide the indraft port function without compromising the underlying essence of my invention. It just so happens that this particular fitting device is well known, readily available, easily installed, extremely easy to use and inexpensive.

In FIG. 2 I show the injection port 50-2 to be OPEN, usually by finger pressure (not shown) whereupon a pipette (e.g., a small tube or tubular hose) 54 is inserted through the injection port fitting and the aperture 51 through the wall of the intercurrent carburetion duct 32. A supply of starting fuel, indicated by arrow 52, is urged through the pipette 54 to issue 56-1 in the intercurrent carburetion duct and near the engine's intake port. The throttle valve 30-2 is preferably (but not necessarily) closed during this period of starting fuel injection.

Upon completion of the injection of a prestart portion of starting fuel admixture through the injection port 50-2, the injection port (viz, indraft port) is CLOSED 50-3 as shown in FIG. 3 and the throttle valve 30-1 is at least partly OPENED. As the engine 10-1 is cranked to attempt start-up (manual rope start or electric start are the usual engine cranking provision) a partial vacuum is produced at the engine's intake port 14 during the "intake" portion of the engine's four cardinal events: INTAKE, COMPRESSION, COMBUSTION and EXHAUST. This partial vacuum draws air from the carburetor inlet 22 and through the carburetor bore and the intercurrent carburetion duct 32 (air flow direction and movement depicted as shown by arrow 58). In effect, the air flow 58 "pushes" the starting fuel vapors 56-2 through the engine's intake port and into the engine's combustion chamber. The immediate presence of the starting fuel vapors introduced into the engine's combustion chamber ought to provide for immediate ignition and combustion and as a result lead to engine start-up and continued running whereupon the usual running fuel, such as gasoline, is carbureted into the engine.

Starting fuel may be dispensed from a containment vessel 60 as shown in FIG. 4 which includes a "pump" including the pump cap 62 which may be worked up and down 66 by a finger 64-1 whereupon starting fuel may be dispensed from an extended pipette 68 that ordinarily protrudes from the pump mechanism outlet while the starting fuel issues 70 from the other end. This kind of pump dispenser container is well known for dispensing household chemicals of all types and is well suited for dispensing moderate volatility starting fuels such as benzine, alcohol and white gasoline.

A squeezable container 80 as shown in FIG. 5 may provide a convenient dispenser for moderate volatility starting fuels when fitted with a cap 84 having a pipette 86 extending therefrom. The pipette is easily inserted into the manually uncoverable injection port 50-2 earlier shown in FIG. 2. Finger pressure, depicted by the arrows 82-1,82-2 acts to squeeze the container 80 placing a positive pressure on its contents which are expelled through the cap 84 and attached pipette to issue forth 88 from the extreme end of the pipette which may conveniently be inserted into the injection port.

Tecumseh Mfg. Co., as well as Briggs and Stratton, is a significant maker of small engines for lawn care equipment, compressors, generators and various other applications. In a typical Tecumseh engine design as shown in FIG. 6 a carburetor 90 is attached to an intermediate intercurrent carburetion duct 92 which couples the carburetor bore with the engine's intake port 93. In this arrangement, I have found that piercing the intercurrent carburetion duct 92 with an aperture into which a manually uncoverable injection port fitting 50-4 may be fitted provides an excellent location for the manual prestart injection of starting fuel supplied through a spout or pipette 92 that might correspond (for example) with the pipette 68 of FIG. 4 or the pipette 86 of FIG. 5. As the finger 64-2 holds the covering cap of the manual injection port 50-4 OPEN, the pipette 94 may be inserted and a prestart portion of starting fuel may then be injected directly into the intercurrent carburetion duct 92 to afford quick draft into the engine's intake port 93 and quick engine startup when cranked.

A Briggs and Stratton updraft carburetor, such as the Flo-Jet™ may also be utilized in an arrangement similar to the showing of FIG. 6. In this application, the intercurrent carburetion duct 92 is repositioned (e.g., inverted) from the showing to permit carburetor 90 (e.g., the carburetor 12 of FIG. 1) to be mounted "from below" to operate in an updraft mode. Otherwise, operation is similar that described for the showing of FIG. 6 used in the downdraft mode; e.g., starting fuel may be injected through the pipette 94 which protrudes through the finger opened indraft port 50-4 so as to produce starting fuel to issue into the intercurrent carburetion duct near the engine's intake port.

A prefilled, pressurized container 100 as shown in FIG. 7 may be utilized to conveniently dispense higher volatility starting fuels, such as ether or blends of ether and benzine, for example. Other similar high volatility fuel choices may also be stored in this type of container, including mixes or blends having propane or butane components. Such a containment vessel is commonly referred to as an "aerosol bomb" and is widely used to dispense starting fluids for automobiles which is ordinarily sprayed into the air-cleaner portion of an engine. Aerosol containers are also used for paint, hair spray and numerous other chemicals with the result that the art for this type of dispensing vessel is mature and cost-effective. In operation, a finger 64-3 may depress the "cap" 102 of a valve fixed into the aerosol container. When pressed downward 104, the stored fuel is released through an extensive pipette 106 which might be inserted through a manual injection duct (indraft port) fitted to a recalcitrant engine's intercurrent carburetion duct for the purpose of enhancing start-up probability.

Single cylinder utility engines are often fitted with "suction lift" carburetors that are mounted on the fuel tank and pick up running fuel through a standpipe. FIG. 8 depicts a type of carburetor used on Briggs and Stratton engines and known as the Pulsa-Jet™ design. In this case, the carburetor body 120 is fitted to the top of a fuel tank (not shown) which has a major chamber for primary fuel storage and a minor chamber which acts as the carburetor's running fuel supply. A long pump pipe 140-1 including a filter 140-2 reaches into the primary fuel storage chamber and through the action of pump components integral with the carburetor body 144 fuel is lifted into and fills the minor chamber. The shorter carburetor pipe 142-1 also fitted with a filter 142-2 extends into the minor chamber and fuel is thus drawn into the carburetor for atomization and mixing with the air. A supply of air 122 (usually drawn through an air filter of some sort) feeds into the carburetor's air inlet 122. A choke 126 may be manually adjusted to modify this air flow. A throttle valve 128 acts in the carburetor bore to further modify air and fuel mixture flow. For review, recall that a choke valve acts upon the air stream before fuel mix and the throttle valve acts upon the air stream subsequent to fuel mix with the air stream. The outlet flange 130 of the carburetor affixes to the engine intake port ordinarily with hardware fitted through at least the mounting holes 134. As a result the air/fuel mixture 132 enters the engine intake port and ultimately flows into the engine's combustion chamber.

An indraft port access fitting 50-5 is shown to be fitted through an aperture piercing the carburetor bore in the intercurrent carburetion duct portion of the carburetor, e.g. that portion of the carburetion bore lying between the throttle valve 128 and the carburetor outlet 130. The artisan should continue to realize that this is not a restrictive location for the injection port. The injection port might also be located near the air inlet where the "X" 146-1 appears, or it might be located where the "X" 146-2 is shown between the choke valve and the throttle valve. Although these alternate locations for the injection duct are not necessarily the "best" locations, they are clearly superior to prior art carburetors which have no convenient provision for the manual injection of a starting fuel.

Although I teach several forms for my invention as depicted in the accompanying figures and description, this by no means shall be construed as limiting the scope of my invention to these particular combination of elements or structural configurations. It is the utter essence of my invention to teach a supplementary prestart injection of a starting fuel method for a small engine carburetor and to give example of apparatus suitable for enabling convenient pre-start fuel injection directly into the carburetor bore or intercurrent carburetion duct thereby enabling immediate induction of a starting fuel/air mixture into the engine's intake port and combustion chamber to enhance quick start-up.

No limitation for the fundamental application of my invention to provide for the manual injection of a starting fuel directly into the carburetor bore or the carburetion duct near the engine's intake port to serve to enhance startability of small internal combustion engines is to be construed from mention of particular makers of engines or models of carburetors. I fully anticipate equivalent advantageous application on virtually all carbureted internal combustion utility engines produced by any of the makers of such engines including, but by no way limited to, Briggs and Stratton, Tecumseh (also Craftsman), Kohler, Onan, Robin, Clinton and Honda.

It is necessary to realize that the manual injection port apparatus might take other forms which can be engineered to suit a particular carburetor application or take advantage of specific mechanical fittings, parts or techniques without departing from the underlying spirit of my invention. Additionally, the artisan shall understand that my invention is not solely limited to any particular engine configuration or cylinder count, nor to any singular carburetor design configuration, but the produced effects may be extended to carburetors of all types in which the prestart manual injection of a starting fuel through a unique manual fuel injection port may produce a desired effect. Furthermore, I anticipate that mere variations of this invention may be implemented which can provide for the manual injection of the starting fuel through a manually accessible indraft port.

It shall be understood that whatever choice of components, fittings, physical embodiments, starting fuel mixtures, containment vessels, dispenser devices, injection port placements, carburetor embodiments or other matters of style or technique shall be construed as mere engineering choices or options utilized to satisfy a specific application for my invention and such choices shall be considered fully within the scope of my claimed invention.

What I claim is:

1. A method for portable prestart manual injection of a starting fuel admixture into an intercurrent carburetion duct immediately coupled between a throttle portion of a carburetor and a combustion chamber intake port portion of an internal combustion engine, comprising:

storing a quantity of starting fuel in a portable containment vessel including a tubule extending therefrom;

temporarily uncovering an aperture in the intercurrent carburetion duct;

inserting said tubule through the aperture;

urging a portion of the starting fuel to issue forth from the portable vessel through the tubule and into the intercurrent carburetion duct;

withdrawing the tubule from the aperture; recovering the aperture; and, cranking the engine to initiate startup of the engine.

2. The method of claim 1 comprising the further steps of:

storing the starting fuel under positive pressure in the portable containment vessel;

seriately fitting a dispensing valve between the portable containment vessel and the tubule;

extending the tubule from the dispensing valve outlet; and, manually operating the dispensing valve to release and thereby urge a limited portion of the pressurized said starting fuel to issue forth from the tubule.

3. The method of claim 1 comprising the further steps of:

storing the starting fuel under substantial positive pressure in the portable containment vessel;

seriately fitting a finger actuated dispensing valve mechanism between the portable containment vessel and the tubule;

extending the tubule from the dispensing valve mechanism outlet;

actuating the dispensing valve mechanism thereby urging release of a limited portion of the pressurized said starting fuel to flow through the tubule; and, directing the tubule and issue of the starting fuel flow through the temporarily uncovered said aperture.

4. The method of claim 1 comprising the further steps of:

providing the starting fuel in a manually squeezable said portable containment vessel including the tubule usually integral with and extensive therefrom;

squeezing the dispensing container to establish a positive pressure upon the starting fuel and thereby urging flow of a limited portion of the starting fuel through the tubule; and, directing issue of the starting fuel flow through the tubule.

5. The method of claim 1 comprising the further steps of:

providing the portable dispensing container with a manually operated dispensing pump;

extending the tubule from an outlet portion of the dispensing pump;

manually operating the dispensing pump to urge a limited portion of the starting fuel to flow through and issue forth from the tubule.

6. The method of claim 1 comprising the further step of:

storing the starting fuel under substantial positive pressure in an aerosol bomb comprising the portable containment vessel and including a manually actuated dispensing valve mechanism integral therewith;

fitting the tubule as extensive from an outlet portion of the dispensing valve mechanism;

actuating the dispensing valve mechanism thereby urging release of a limited portion of the pressurized said starting fuel to flow through and issue forth from the tubule.

7. A method for portable prestart manual injection of a starting fuel admixture through a temporary priming port into an intercurrent carburetion bore immediately coupled between an air and running fuel mixing portion of a carburetor and a combustion chamber intake port of an internal combustion engine, comprising:

storing a supply of the starting fuel admixture in a portable containment vessel including a tubule extensive therefrom;

uncovering the temporary priming port;

inserting said tubule through the temporary priming port;

urging a portion of the starting fuel admixture to issue forth from the portable containment vessel, through the tubule and into the intercurrent carburetion bore;

withdrawing the tubule from the temporary priming port; recovering the temporary priming port; and, cranking the engine to initiate startup of the engine.

8. The method of claim 7 further comprising:

storing a supply of the starting fuel admixture under positive pressure in the portable containment vessel;

fitting the portable containment vessel with a dispensing valve;

extending the tubule from the dispensing valve outlet; and, manually operating the dispensing valve to release a limited portion of the pressurized said starting fuel admixture to issue forth from the tubule.

9. The method of claim 7 further comprising:

storing a supply of the starting fuel admixture under positive pressure in the portable containment vessel;

seriately fitting a finger actuated dispensing valve mechanism coupled between the portable containment vessel and the tubule; and, actuating the dispensing valve mechanism to urge release of a limited portion of the pressurized said starting fuel admixture to flow through and issue forth from the tubule.

10. The method of claim 7 further comprising:

providing the supply of the starting fuel admixture in a manually squeezable said portable containment vessel; and, squeezing the portable containment vessel to establish a positive pressure upon the supply of starting fuel admixture and thereby produce flow of a portion of the starting fuel through and issue forth from the tubule.

11. The method of claim 7 further comprising:

seriately including a manually operated dispensing pump between the potable containment vessel and the tubular pipette; and, manually operating the dispensing pump to produce flow of a limited portion of the starting fuel admixture through and issue forth the pipette.

12. The method of claim 7 further comprising:

prefilling and sealing the starting fuel admixture under substantial positive pressure in the portable containment vessel;

fitting the prefilled and sealed said possible containment vessel with a manually actuated dispensing valve mechanism coupled seriately with the pipette; and, actuating the dispensing valve mechanism thereby urging release of a limited portion of the pressurized said starting fuel to flow through and issue forth from the pipette.

13. The method of claim 7 further comprising:

storing the starting fuel under substantial positive pressure in an aerosol bomb comprising a prefilled and sealed said portable containment vessel and including a manually actuated dispensing valve mechanism coupled seriately with the tubular pipette; and, actuating the dispensing valve mechanism thereby urging release of a limited portion of the pressurized said starting fuel to flow through and issue forth from the pipette.

14. Means for enabling temporary manual injection of a starting fuel admixture into an intercurrent carburetion duct means coupled between an air and running fuel mixing portion of a carburetor means and combustion chamber intake port means of an internal combustion engine means, comprising:

means providing a usually covered priming port means coupled into the intercurrent carburetion duct means;

means enabling temporary uncovering of the priming port means;

means providing a portable supply of the stinting fuel admixture including a tubule means extending therefore which is sized for temporary insertion through the priming port means and into the intercurrent carburetion duct means;

means for effecting manual injection of a priming portion of the starting fuel admixture through the tubule means, as temporarily inserted through the temporarily uncovered said priming port means: and effectively into the intercurrent carburetion duct means;

means for recovering and sealing the temporarily uncovered said priming port means; and, means for cranking and thereby at least attempting startup of the engine means.

15. The means of claim 14 further comprising:

means for storing the starting fuel admixture under positive pressure in a portable containment vessel; and means enabling manual release of a limited portion of the starting fuel admixture to flow forth from the portable containment vessel and usually through the tubule means coupled therewith.

16. The means of claim 14 further comprising:

means for storing the starting fuel admixture under positive pressure in a portable containment vessel; and, means enabling finger actuated dispensing of a limited portion of the starting fuel admixture whereby the limited portion may be urged through and issue forth from the tubule means coupled herewith.

17. The means of claim 14 further comprising:

means for storing the starting fuel admixture in form of a manually squeezable portable containment vessel usually including the tubule means extensive therefrom, and means whereby a temporary positive pressure is established upon the supply of starting fuel admixture in response to the manual squeezing of the portable containment vessel and thereby a flow of a portion the starting fuel admixture is urged through to issue forth from the tubule means.

18. The means of claim 14 further comprising:

means for storing the starting fuel admixture in a portable dispensing container, and, means for manually pumping and thereby urging a portion of the starting fuel admixture to issue forth from the portable dispensing container and through the tubule means.

19. The means of claim 14 further comprising:

means for storing the starting fuel admixture under substantial positive pressure in a portable containment vessel;

manual dispensing valve means coupled with the portable containment means;

finger actuator means coupled with the manual dispensing valve means and therewith effective to urge a limited portion of the pressurized said starting fuel admixture to flow through and issue forth from the tubule means.

20. The means of claim 14 further comprising:

means for storing the starting fuel admixture under substantial positive pressure in an "aerosol bomb" means comprising a prefilled and sealed said portable containment vessel and including a manual dispensing valve means coupled with the tubule means; and, finger actuator means coupled with the manual dispensing valve means and therewith effective to urge a limited portion of the pressurized said starting fuel admixture to flow through and issue forth from the tubule means.

* * * * *